US005664498A

United States Patent [19]

Theurer et al.

[11] Patent Number: 5,664,498

[45] Date of Patent: Sep. 9, 1997

[54] TRACK RENEWAL MACHGINE

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 715,643

[22] Filed: Sep. 18, 1996

[30] Foreign Application Priority Data

Oct. 31, 1995 [AT] Austria ..... 1801/95

[51] Int. Cl.[6] ..... E01B 29/05

[52] U.S. Cl. ..... 104/6; 104/2; 104/7.3

[58] Field of Search ..... 104/2, 5, 6, 7.3; 37/104, 105; 171/16

[56] References Cited

U.S. PATENT DOCUMENTS

| | | | |
|---|---|---|---|
| 3,330,219 | 7/1967 | Plasser et al. | 104/2 |
| 4,046,077 | 9/1977 | Theurer et al. | 104/6 |
| 4,211,170 | 7/1980 | Theurer | 104/7.3 |
| 4,867,068 | 9/1989 | Valditerra | 104/6 |
| 5,357,867 | 10/1994 | Theurer et al. | 104/2 |

FOREIGN PATENT DOCUMENTS

| | | |
|---|---|---|
| 0 085 790 | 8/1985 | European Pat. Off. . |
| 35 28 152 | 2/1986 | Germany . |

*Primary Examiner*—S. Joseph Morano
*Attorney, Agent, or Firm*—Collard & Roe, P.C.

[57] ABSTRACT

A track renewal machine comprises an elongated machine frame supported on undercarriages for mobility in an operating direction, a device for receiving ties of an old track mounted on the machine frame, a device for planing the ballast bed mounted on the machine frame, the planing device comprising a planing shield extending transversely to the machine frame and two transversely spaced boundary shields extending in the longitudinal direction at respective sides of the planing shield, and a device for laying ties of a new track mounted on the machine frame and positioned between the boundary shields.

9 Claims, 2 Drawing Sheets

Fig. 3
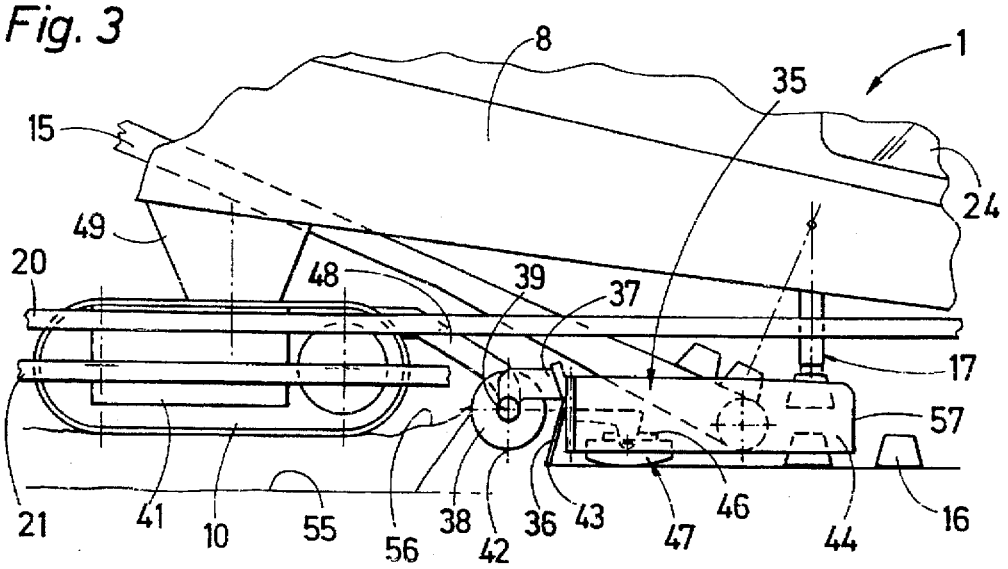
Fig. 4
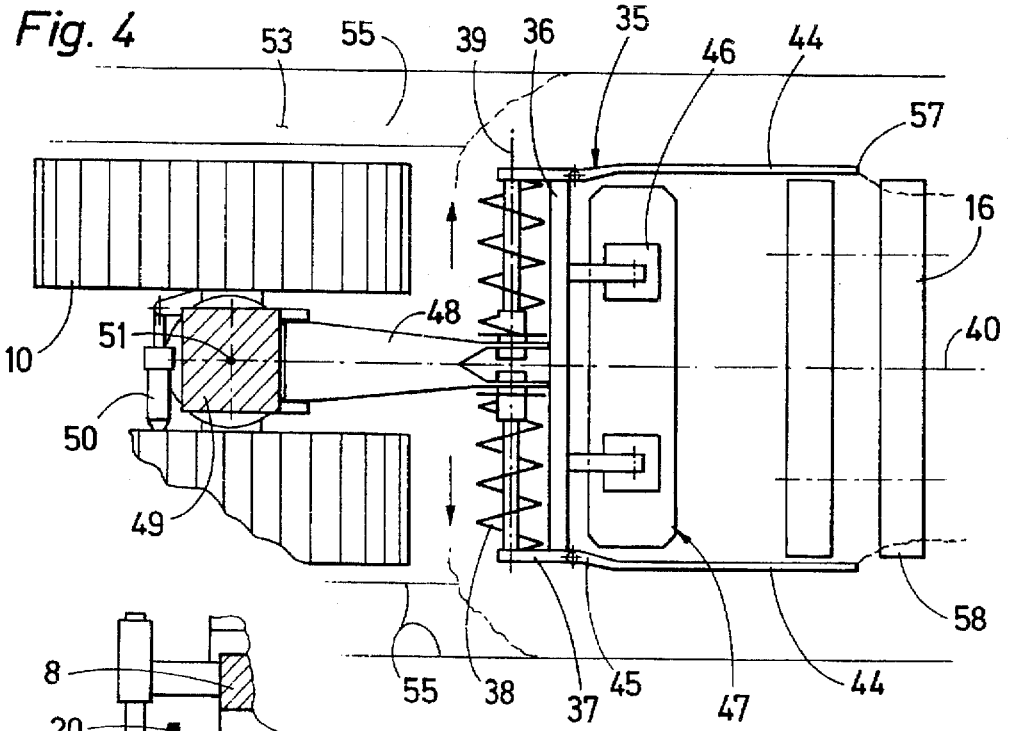
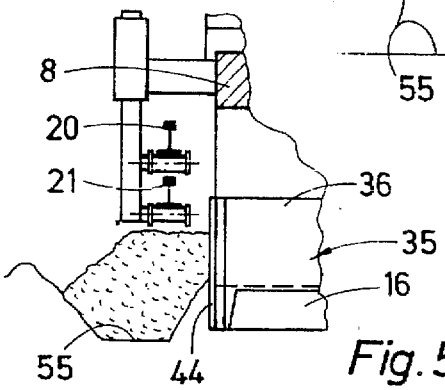
Fig. 5

TRACK RENEWAL MACHGINE

BACKGROUND OF THE INVENTION

1. Field of the Invention

The present invention relates to a machine for removing an old track and laying a new track on a ballast bed having a shoulder, each track being comprised of rails fastened to ties, which comprises an elongated machine frame extending in a longitudinal direction and supported on undercarriages for mobility in an operating direction, a device for receiving ties of the old track mounted on the machine frame, a device for planing the ballast bed mounted on the machine frame, the planing device comprising a planing shield extending transversely to the machine frame, and a device for laying ties of the new track mounted on the machine frame.

2. Description of the Prior Art

Such a track renewal machine is known, for example, from U.S. Pat. No. 5,357,867. During the continuous advancement of the machine, the ties of the old track are removed and ballast is excavated from the exposed cribs by an endless excavating chain. A trailing, vertically adjustable V-shaped ballast plow then planes the ballast bed for preparing the ballast bed for the subsequent laying of the ties of the new track.

It is known from European patent publication No. 0 085 790 to mount a rotating screw conveyor ahead of a planing shield to convey ballast to a conveyor band for removal after a track section has been lifted off the ballast bed to expose the same.

Such a combination of a planing shield and screw conveyor is also known from German patent No. 3,528,152. In this track renewal machine, ballast is continuously conveyed to a conveyor band extending in the longitudinal direction of the machine while the track is raised off the ballast bed and the ballast is thus displaced in the longitudinal direction

SUMMARY OF THE INVENTION

It is the primary object of this invention to provide a track renewal machine of the first-described type, which enables an exact planing of the ballast bed to be performed while holding the distance between the planing device and the device for laying the ties of the new track to a minimum.

The above and other objects are accomplished in such a machine according to the invention by providing a ballast bed planing device which comprises two transversely spaced boundary shields extending in the longitudinal direction at respective sides of the planing shield, and positioning the device for laying ties of the new track between the boundary shields.

This lateral bounding of the tie laying device makes it possible to displace the excess ballast plowed up by the planing shield directly to the shoulders along a greatly reduced conveying path. The two boundary shields at the same time prevent any ballast accumulated on the shoulders from entering the exactly planed ballast bed prepared for laying the ties of the new track. Immediately after the ties of the new track have been laid, the ballast accumulated on the shoulders is used at the tie ends to hold the ties of the new track in position and thus to stabilize the position of the newly laid track, which is an additional advantage. This is an automatic result of the operation, as the trailing ends of the boundary shields move the ballast against the tie ends during the continuous advance of the machine. In the operation of the machine, the excess ballast plowed up by the planing shield above the planed surface of the ballast bed is transversely displaced to the shoulders and, without requiring separate transport means, this ballast is automatically used directly to stabilize the track position.

BRIEF DESCRIPTION OF THE DRAWING

The above and other objects, advantages and features of the present invention will become more apparent from the following detailed description of a now preferred embodiment thereof, taken in conjunction with the accompanying, partly schematic drawing wherein FIGS. 1 and 2, viewed together, are side views showing a track renewal machine according to this invention;

FIG. 3 is an enlarged, fragmentary side view showing the planing device of FIG. 1;

FIG. 4 is a simplified top view of the planing device of FIG. 3; and

FIG. 5 is a fragmentary end view showing the portion of the planing device in the range of a boundary shield.

DETAILED DESCRIPTION OF THE PREFERRED EMBODIMENT

Figures 1, 2:
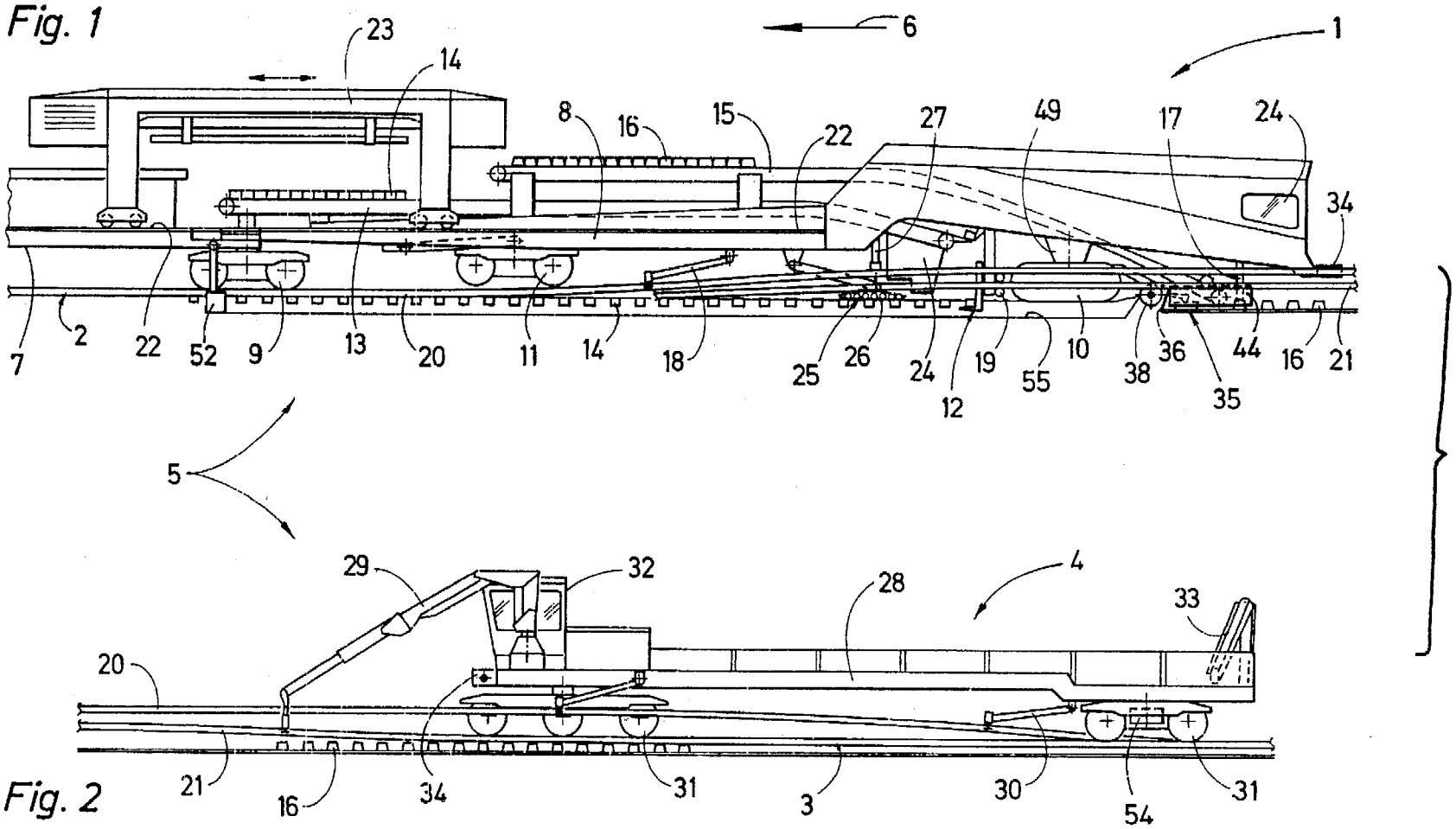

Referring now to the drawing and first to FIG. 1, there is shown machine 1 for removing old track 2 and laying new track 3 on a ballast bed having a shoulder, each track being comprised of rails 20, 21 fastened to ties 14, 16. Machine 1 combined with rail spreading car 4, shown in FIG. 2, constitutes a track renewal installation 5. Locomotive 7 advances machine 1 coupled thereto in an operating direction indicated by arrow 6, and the installation also comprises tie transport cars (not shown).

Machine 1 comprises elongated machine frame 8 extending in a longitudinal direction and supported on undercarriages for mobility in the operating direction. Track-bound undercarriage 9 belongs to locomotive 7 to support machine frame 8 on old track 2 while off-track, self-propelled endless track carriage 10 is vertically adjustably connected to the rear end of the machine frame. The endless track carriage has its own drive 41 (FIG. 3). Further undercarriage 11 is used only during transit of the machine between operating sites and is raised into an inoperative position during the track renewal operation. Device 12 for receiving ties 14 of old track 20 is mounted on machine frame 8 immediately ahead of endless track carriage 10, in the operating direction, and conveyor arrangement 13 is associated with tie receiving device 12 to remove old ties 14. A further conveyor arrangement 15 is arranged to convey new ties 16 to device 17 for laying the new ties behind the endless track carriage, in the operating direction. Portal crane 23 runs on rails 22 on machine frame 8 for transporting old ties 14 to, and new ties 16 from, freight cars (not shown).

As conventional in mobile track renewal trains, machine 1 further comprises vertically and laterally adjustable rail guides 18, 19 for receiving rails 20 of the old track and rails 21 of the new track. Operator's cab 24 is mounted on machine frame 8 within view of the tie removal and laying site to enable operating personnel to monitor and control the operation. The lateral and vertical position of machine 1 is controlled by sensing device 25 which comprises guide carriage 26 following the position of old track 2 and is vertically adjustable by drive 27. The guide carriage rolls on ties 14 of the old track, from which rails 20 have already been removed, ahead of device 12 for receiving the old ties, in the operating direction.

Generally conventional rail spreading car 4 (FIG. 2) follows machine 1 in the operating direction at a constant distance during the track renewal operation. The car comprises machine frame 28 and vertically and laterally adjustable rail guides 29 for the new rails, and rail guides 30 for guiding old rails 20 to the center of the track and laying them on the ground. Undercarriages 31 support machine frame 28 on new track 3. Driver's cab 32 and crane 33 are mounted on the machine frame. During transit from one operating site to another, coupling 34 links machine frame 28 to machine frame 8 for common movement. During the track renewal operation, machine 4 is propelled by drive 54.

Device 35 for planing the ballast is mounted on machine frame 8 between device 17 for laying new ties 16 and endless track carriage 10, which immediately precedes device 17 in the operating direction. As best seen in FIGS. 3 to 5, the planing device comprises planing shield 36 extending in a substantially vertical plane transversely to machine frame 8 and two transversely spaced boundary shields 44 extending in the longitudinal direction at respective sides of planing shield 36. Device 17 for laying ties 16 of new track 3 is positioned between boundary shields 44.

As clearly shown in FIG. 4, forward ends of boundary shields 44, in the operating direction, are connected to planing shield 36. Vibratory ballast compacting device 47 actuated by vibrators 46 is arranged between planing shield 36 and device 17 for laying ties 16. Machine 1 further comprises screw conveyor 38 arranged immediately ahead of planing shield 36, in the operating direction. The transversely spaced ends of planing shield 36 carry brackets 37 holding screw conveyor 38. The screw conveyor is rotatable about horizontal axis 39 extending transversely to machine frame 8 and comprises two parts symmetrically arranged with respect to vertical center plane 40 of machine frame 8. The screw conveyor has a length corresponding to the length of planing shield 36. As can be seen in FIG. 3, screw conveyor 38 has a bottom boundary line 42 extending transversely to the longitudinal direction and planing shield 36 has a substantially horizontally extending bottom planing edge 43, bottom boundary line 42 of screw conveyor 38 extending above bottom planing edge 43 of planing shield 36 in a vertical direction.

Front ends 45 of boundary shields 44, in the operating direction, are connected to the ends of planing shield 36 or to brackets 37. Planing device 35, including screw conveyor 38 is mounted on a rear end of a carrier frame 48 extending in the longitudinal direction, and a support element 49 is arranged between endless track carriage 10 and machine frame 8, the front end of the carrier frame being mounted on the support element, and a drive 50 being provided for displacing the carrier frame front end about vertical pivot axis 51.

Machine 1 further comprises a vertically adjustable shoulder plow 52 preceding each boundary shield 44 in the operating direction. As shown in FIG. 1, each shoulder plow is vertically adjustably mounted at each track shoulder 53 in the range of undercarriage 9 of locomotive 7.

Illustrated track renewal installation 5 operates in the following manner:

In transit to an operating site, the installation operates as a unit in which machine frame 8 and rail spreading car 4 are connected by coupling 34. At this stage, machine frame 8 runs on track-bound undercarriage 11 lowered to engage the track, its rear end, in the operating direction, is supported on track-bound front undercarriage 31 of car 4, and off-track endless track carriage 10 is retracted. At the operating site, the front end of machine frame 8 is supported on undercarriage 9 of locomotive 7, and undercarriage 11 is retracted to increase the length of the work area underneath the machine frame. The rear end of machine frame 8 is then supported on extended endless track carriage 11 driven by motor 41 after car 4 has been uncoupled from machine frame 8 to be propelled independently by drive 54 during the operation.

Meanwhile, the rail fasteners of rails 20 of old track 2 have been removed, and rails 21 of new track 3 have been laid on the ends of ties 14 at both sides of old track 2 and substantially parallel thereto. In a generally conventional and assembly-line manner, rails 20 of the old track, from which the fasteners were removed, are spread apart, ties 14 of the old track are removed, ties 16 of the new track are laid, and rails 21 of the new track are positioned in place by guides 29. Such continuous track renewal operations being well known, for example from U.S. Pat. No. 5,357,867, they are not further described herein.

As locomotive 7 continuously drives machine 1 in the operating direction indicated by arrow 6 while shoulder plows 52 are lowered, channels 55 at both sides of old track 2 are created (see FIGS. 4 and 5). Planing device 35, which is arranged immediately behind off-track endless track carriage 10, planes exposed, irregular surface 56 of the ballast bed from which ties 14 of the old track have been removed. As planing shield 36 moves along ballast bed surface 56, its lower end 43 operates like the blade of a plowshare and pushes an accumulation of ballast in front of the planing shield, which is received by screw conveyor 38 and laterally displaced into channels 55 at the track shoulders. (In the illustrated embodiment, the screw conveyor has two symmetrically arranged parts to displace one half of the ballast accumulations to one shoulder and the other half to the opposite shoulder. However, it is also possible to operate only one shoulder plow 52 to create a single channel 55 if the screw conveyor comprises a single screw to displace the ballast accumulations into the single channel.)

The two boundary shields 44 of planing device 35, which succeed planing shield 36 in the operating direction, prevent ballast from flowing back from shoulders 53 to the planed ballast bed surface in the region of ballast compacting unit 47 and device 17 for laying ties 16 of the new track so that proper laying of the ties on the planed surface is assured. Immediately behind the point where ties 16 have been laid, the ballast accumulated on the shoulders flows past rear ends 57 of boundary shields 44 towards ends 58 of ties 16 whereby the position of the ties on the planed ballast bed is fixed and stabilized.

If desired, screw conveyor 38 for displacing the ballast accumulated by advancing planing shield 36 to the shoulder or shoulders could be replaced by a V-shaped design of the planing shield, which would then operate like a snow plowshare.

What is claimed is:

1. A machine for removing an old track and laying a new track on a ballast bed having a shoulder, each track being comprised of rails fastened to ties, which comprises (a) an elongated machine frame extending in a longitudinal direction and supported on undercarriages for mobility in an operating direction, (b) a device for receiving ties of the old track mounted on the machine frame, (c) a device for planing the ballast bed mounted on the machine frame, the planing device comprising (1) a planing shield extending transversely to the machine frame and (2) two transversely spaced boundary shields extending in the longitudinal direction at respective sides of the planing shield, and (d) a device for laying ties of the new track mounted on the machine frame and positioned between the boundary shields.

2. The machine of claim 1, wherein forward ends of the boundary shields, in the operating direction, are connected to the planing shield.

3. The machine of claim 1, further comprising a vibratory ballast compacting device arranged between the planing shield and the device for laying ties.

4. The machine of claim 1, further comprising a screw conveyor arranged immediately ahead of the planing shield, in the operating direction, the screw conveyor being rotatable about a horizontal axis extending transversely to the machine frame and comprising two parts symmetrically arranged with respect to a vertical center plane of the machine frame.

5. The machine of claim 4, wherein the screw conveyor has a length corresponding to the length of the planing shield.

6. The machine of claim 4, wherein the screw conveyor has a bottom boundary line extending transversely to the longitudinal direction and the planing shield has a bottom planing edge, the bottom boundary line of the screw conveyor extending above the bottom planing edge of the planing shield.

7. The machine of claim 1, wherein one of the undercarriages is a self-propelled endless track carriage vertically adjustably connected to the machine frame, the ballast bed planing device being arranged immediately behind the endless track carriage, in the operating direction.

8. The machine of claim 7, further comprising a carrier frame extending in the longitudinal direction and having a front end and a rear end, in the operating direction, the planing device being mounted on the rear end of the carrier frame, a support element arranged between the endless track carriage and the machine frame, the front end of the carrier frame being mounted on the support element, and a drive for displacing the carrier frame front end about a vertical pivot axis.

9. The machine of claim 1, further comprising a ballast shoulder plow preceding each boundary shield in the operating direction.

* * * * *